US006134397A

United States Patent [19]

Shimazaki et al.

[11] Patent Number: 6,134,397

[45] Date of Patent: Oct. 17, 2000

[54] NON-MAGNETIC ONE-COMPONENT DEVELOPING APPARATUS

[75] Inventors: Hiromitsu Shimazaki, Kaho-gun; Akihiro Tsuru, Chikugo; Hironori Taguchi, Miyaki-gun; Kazuhiko Noda, Chikushino, all of Japan

[73] Assignee: Matsushita Electric Industrial Co., Ltd., Japan

[21] Appl. No.: 09/285,725

[22] Filed: Apr. 5, 1999

[30] Foreign Application Priority Data

Apr. 9, 1998 [JP] Japan ..... 10-097266

[51] Int. Cl.[7] ..... G03G 15/06

[52] U.S. Cl. ..... 399/55; 399/281; 399/285

[58] Field of Search ..... 399/55, 272, 281, 399/282, 285, 290, 291, 149, 150

[56] References Cited

U.S. PATENT DOCUMENTS 5,617,190 4/1997 Takenaka et al. ..... 399/285 X
5,826,138 10/1998 Tsuru et al. .

FOREIGN PATENT DOCUMENTS 1-10282 1/1989 Japan .
9-90723 4/1997 Japan .

*Primary Examiner*—Arthur T. Grimley
*Assistant Examiner*—Quana Grainger
*Attorney, Agent, or Firm*—Parkhurst & Wendel, L.L.P.

[57] ABSTRACT

A toner supply bias voltage that is a vibrating voltage comprising an a.c. voltage and a d.c. voltage is applied to a toner supply roller. The d.c. voltage of toner supply bias voltage is changed in dependence upon a variation in the value of developing bias voltage. The lowering in the density at the leading end part of an image, the lowering in the density at the trailing end part of an image, and the uneven developing can be eliminated by satisfying the relationships $$100 \leqq |VB| \leqq |VSR|,$$

$$2(|VSR-VB|+50) \leqq |VPP| \leqq 2|VSR| \text{ and}$$

$$f \geqq v/l$$

are satisfied, where VB is a developing bias voltage (unit: Volt), VSR is a d.c. voltage of the toner supply bias voltage (unit: Volt), VPP is a peak-to-peak value of the a.c. voltage (unit: Volt), f is a frequency (unit: Hz), v is a relative speed at the contact position between the developing roller 5 and the toner supply roller 6 (unit: mm/sec), and l is a nip width between the developing roller 5 and the toner supply roller 6 (unit: mm).

4 Claims, 2 Drawing Sheets

NON-MAGNETIC ONE-COMPONENT DEVELOPING APPARATUS

FIELD OF THE INVENTION

The present invention relates to a nonmagnetic one-component developing apparatus for use in the electro-photography processes and electrostatic recording devices, which developing apparatus employing as the developer the nonmagnetic toner particles alone.

BACKGROUND OF THE INVENTION

Among the image developing apparatus for visualizing a latent image by electro-photography prcess (hereinafter referred to as electro-photography device), a dry-toner type has been forming the mainstream line. An increasing number of copying machines, laser printers, facsimile devices using ordinary paper, and the like equipment incorporate such type of electro-photography device. This is an applied device of an electro-photography process technology, in which an electrostatic latent image formed on a photosensitive medium is visualized with the use of nonmagnetic toner particles.

In view of the advantages in downsizing and cost reduction, the use of a nonmagnetic one-component developing apparatus (developing apparatus) is increasing.

An electro-photography device using a conventional developing apparatus is described below in its structure and the operation with reference to the drawings. FIG. 2 shows structure of an electro-photography device using a conventional developing apparatus.

In FIG. 2, a photosensitive medium 1 comprises a photosensitive layer coated around a metal drum. A charger 2 arranged adjacent to the photosensitive medium 1 comprises a charging wire 2*a* made of tungsten or the like wire, a metal shield panel 2*b* and a grid 2*c*. The charging wire 2*a* causes corona discharge and the ion produced by the discharge evenly charges the outer surface of the photosensitive medium 1 through the grid 2*c*. An exposure optical system 3 directs an exposure beam 4 onto the photosensitive medium 1 so as to form an electrostatic latent image thereon. The exposure beam 4 is subjected to light intensity modulation or pulse width modulation by means of a laser drive circuit.

A toner supply roller 6 supplies a toner 10 agitated and carried by a toner agitating member 11 on the surface of a developing roller 5, or a toner carrier. The toner supply roller 6 is connected to a toner supply bias power source 26 for obtaining a toner supply bias voltage. By delivering a voltage comprising a d.c. voltage and an a.c. voltage as the toner supply bias voltage, the transfer of toner onto the developing roller 5 and the scrape-off of unconsumed toner can be made simultaneously and efficiently. This also eliminates both of the problems, the lowering in the density at the leading end part of an image and the lowering in the density at the trailing end part of an image. The toner supply roller 6 is adapted to make contact with the developing roller 5. The developing roller 5 has its core made of metal such as stainless steel, covered with elastic material layer, and is rotatably attached to a developing hopper 9. Numeral 5*a*, 6*a* denote a shaft.

The toner 10 fed by the toner supply roller 6 is held by a toner regulating blade 7 so as to be subjected to functional electrification, and a thin layer of toner 10 is formed over the outer periphery of the developing roller 5. The developing roller 5 is adapted to make contact with or located adjacent to the photosensitive medium 1; the toner 10 is transferred onto and stuck to a part of the photosensitive medium 1 where a latent image is formed, so as to visualize the latent image. The transfer of toner 10 is conducted by the effect of a bias voltage applied by a developing bias power source 12.

The toner-regulating blade 7 is composed of a metal leaf spring member 7*a* and a toner regulating member 7*b* adapted to make contact with the outer periphery of the developing roller 5. The toner-regulating blade 7 is secured to a blade holder 8 with fastening screws. The toner 10 which has been stored in the developing hopper 9 is agitated by a toner agitating member 11 which depicts a circle in synchronization with the toner supply roller 6 in order to prevent the toner 10 stored in the developing hopper 9 from coagulating, and to feed the toner 10 onto the supply roller 6.

Sheets 15 stored in a sheet cassette 14 are taken out one by one by a semicircular roller 16, and are conveyed by a conveying roller 17. The taken-out sheet 15 is transferred by the conveying roller 17 in the direction as indicated by an arrow symbol A. A registration roller 18 once stops and holds each of the sheets 15 in order to align the sheet with a toner image formed on the photosensitive medium 1, and a driven roller 19 makes contact with the registration roller 18. A transfer roller 20 makes contact with the photosensitive medium 1. As soon as a toner image formed on the photosensitive medium 1 arrives, as a result of rotation, at a point where the transfer roller 20 and the photosensitive medium 1 are making contact to each other, the sheet 15 reaches concurrently at the point. A transfer bias power source 24 supplies a high bias voltage to a metal shaft 20*a* of the transfer roller 20 so as to apply a charge having a polarity reverse to that of the toner 10 onto the rear surface of the sheet 15, and accordingly, the toner image on the photosensitive medium 1 is transferred to the sheet 15.

The sheet 15 is transferred to the left in the illustration, and held between a heat roller 22 which incorporates a heat source in itself and a press roller 23 of a fixing unit 21 so that the toner image transferred on the sheet 15 is fixed. The photosensitive medium 1 after the toner image formed thereon is transferred onto the sheet 15 is cleaned by a cleaning blade 50 provided for removing residual toner, and a discharger 13 irradiates a light on the photosensitive medium 1 for removing residual charge, in preparation for a next process step.

As the image density varies due to change in the operating environments and aging in the above described electro-photography devices, an image density control means 28 is provided for automatically controlling the image density, or controlling it by hand. The image density control means 28 optimizes image density by sending a signal to a developing bias voltage controlling means 27 for changing the developing bias voltage to be applied on the developing roller 5.

When the developing bias voltage alone is changed for adjusting the image density in an electro-photography device of the above described structure, the potential between the developing roller 5 and the toner supply roller 6 also changes. Applying the superimposed voltage comprising a d.c. voltage and an a.c. voltage on the toner supply roller 6 is for supplying the toner 10 to the developing roller 5 and for scraping the unconsumed toner 10 off the surface of the developing roller 5 at a same time.

If an insufficient quantity of toner 10 is supplied to the developing roller 5, image density at the trailing end part becomes low when an image of high overall density is printed. On the other hand, an insufficient scraping of the unconsumed toner 10 results in a lowered density at the leading end part of an image. Because the toner 10 sticking on the surface of the developing roller 5 passes through under the toner regulating blade 7 for a plurality of times, as a result, the charging quantity of the toner increases. Therefore, if the developing bias is changed which bring about a change in the difference in the potential between the developing roller 5 and the toner supply roller 6, then either the insufficiency of toner 10 supply or the insufficient scraping of unconsumed toner 10 happens, and the quality of image deteriorates.

The present invention addresses the above described problems inherent to the prior art, and aims to offer a developing apparatus with which the quality of image is well preserved even if the developing bias voltage is changed for the purpose of adjusting the density of an image.

SUMMARY OF THE INVENTION

A nonmagnetic one-component developing apparatus in accordance with the present invention for visualizing an electrostatic latent image carried on an electrostatic latent image carrier by providing a toner thereon comprises a developing roller having its outer surface on which a layer of nonmagnetic one-component toner is formed, a toner supply roller made of an electro-conductive member for feeding the toner onto the developing roller, which toner supply roller being displaced in contact with the developing roller, and a toner regulating blade for regulating the quantity of the toner in order to form a thin layer thereof on said developing roller. The developing apparatus further comprises means to apply a d.c. developing bias voltage on said developing roller; means to apply a toner supply bias voltage, which voltage being a superimposed voltage comprising an a.c. voltage and a d.c. voltage, to said toner supply roller, means to control the image density by changing said developing bias voltage, and means to change the d.c. voltage of said toner supply bias voltage; wherein the d.c. voltage of said toner supply bias voltage is changed in accordance with the change in said developing bias voltage, and a relationship $100 \leqq |VB| \leqq |VSR|$ is satisfied, where VB is said developing bias voltage and VSR is the d.c. voltage of said toner supply bias voltage (unit: Volt).

DESCRIPTION OF THE PREFERRED EMBODIMENT

Figure 1:
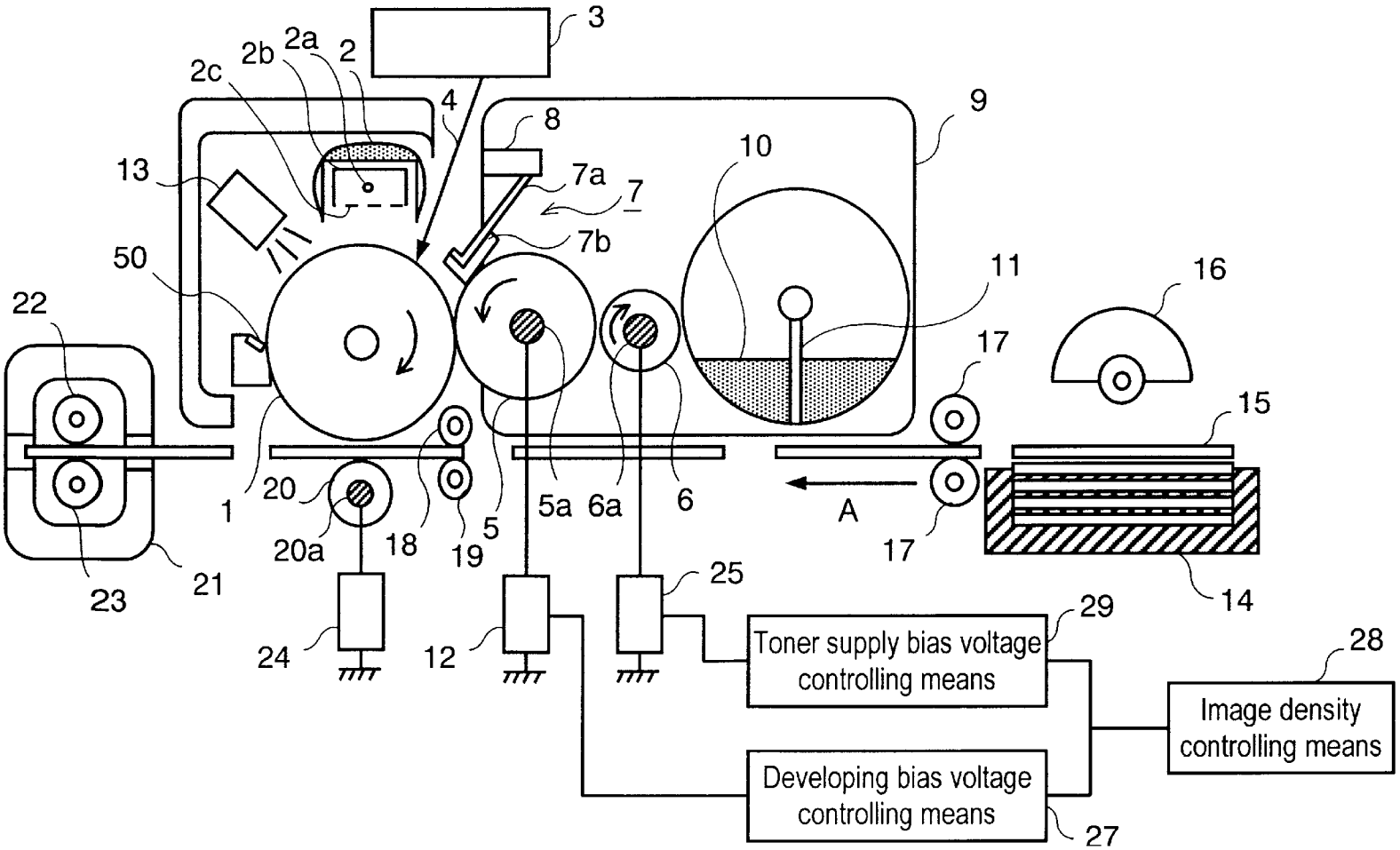
FIG. 1 Structure of an electro-photography device using a nonmagnetic one-component developing apparatus of the present invention.
Figure 2:
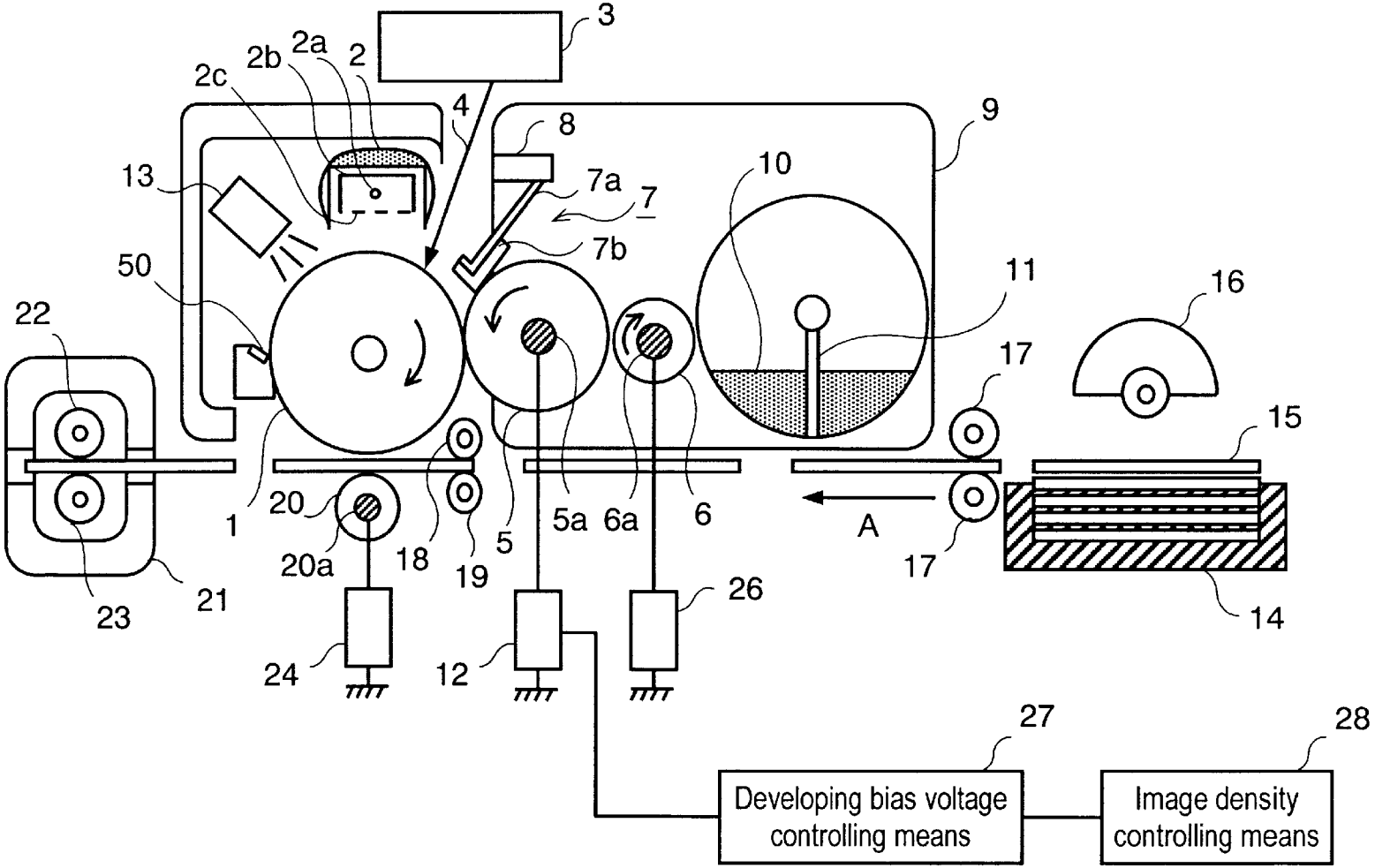
FIG. 2 Structure of an electro-photography device using a conventional nonmagnetic one-component developing apparatus.

Description is made on an exemplary embodiment of the present invention referring to FIG. 1, which illustrates the structure of an electro-photography device using a developing apparatus of the present invention.

In FIG. 1, a photosensitive medium 1 is a metal drum made of aluminum or the like as a base material, and is coated its outer surface with a thin film photosensitive layer made of selenium (Se), organic photoconductor (OPC) or the like. A charger 2 arranged adjacent to the photosensitive medium 1, which being an electrostatic latent image carrier, is composed of a charging wire 2*a* made of tungsten or the like material, a metal shield panel 2*b* and a grid panel 2*c*. The corona discharge occurs from the charging wire and the ion produced as a result of the discharge charges the entire outer surface of the photosensitive medium 1 through the intermediary of the grid panel 2*c*. An exposure optical system 3 directs an exposure beam 4 onto the photosensitive medium 1; that is, an image signal is subjected to light intensity modulation or pulse width modulation by means of a laser drive circuit so as to form a latent image on the photosensitive medium 1.

A toner supply roller 6 feeds the toner 10 onto the surface of the developing roller 5, or a toner carrier. The toner 10 which has been stored in a developing hopper 9 is agitated by a toner agitating member 11 to be transferred onto the toner supply roller 6, which agitating member 11 being supported rotatable at the both ends by the developing hopper 9. A toner supply bias power source 25 applies a toner supply bias voltage on the toner. supply roller 6. By applying a toner supply bias voltage comprising a d.c. voltage and an a.c. voltage, the transfer of toner 10 to the developing roller 5 and the scraping of unconsumed toner off the surface can be made simultaneously and efficiently. This also eliminates both of the problems; the lowering in the density at the leading end part of an image and the lowering in the density at the trailing end part of an image. The toner supply roller 6 is placed to make contact with the developing roller 5.

The developing roller 5 is composed of a stainless steel, or other metal, shaft 5*a* as a core covered over its outer peripheral surface with an electro-conductive silicone rubber as an elastic member having a resistance of $10^6$ ohms. The developing roller 5 is rotatably supported by the developing hopper 9 at both sides. A developing bias power source 12, which being a fixed voltage source, is connected to the shaft 5*a* of developing roller 5. The rubber hardness of the developing roller 5 is preferably in a range from 30 to 60 degrees, and smoother the surface roughness of the outer surface of the developing roller 5 the more uniform thickness of a thin toner layer is formed. Accordingly, the surface roughness Rz is preferably less than 7 $\mu$m. In the present embodiment, the developing roller 5 has a rubber hardness of 40 degrees and a Rz surface roughness of 3 $\mu$m.

The toner supply roller 6 is covered over its outer peripheral surface of the metal shaft 6*a* with an electro-conductive-foam so as to have a resistance of $10^6$ ohms. A toner supply bias power source 25 is connected to the shaft 6*a*. By applying a superimposed voltage comprising a d.c. voltage and an a.c. voltage as the toner supply bias voltage, the toner supply roller 6 feeds the toner 10 delivered from the developing hopper 9 to the developing roller 5. And, at the same time it scraps off the toner 10 which remains on the developing roller 5 without being used during development. The nip width between the toner supply roller 6 and the developing roller 5 is set to be 2 mm.

The developing bias power source 12 and the toner supply bias power source 25 are connected to a developing bias voltage controlling means 27 and a toner supply bias voltage controlling means 29, respectively. And an image density control means 28 is connected to the developing bias voltage controlling means 27 and the toner supply bias voltage controlling means 29. When a manual input is made through a control panel, the image density can be changed at seven stages. The image density controlling means 28 causes the developing bias power supply 12 and the toner supply roller bias power source 25 to change their output voltages keeping a relative relationship. Namely, the d.c. voltage of the toner supply bias voltage is made to change in accordance with the change of the developing bias voltage.

The toner 10 fed by the toner supply roller 6 is held by a toner regulating blade 7 so as to be subjected to frictional electrification, and a thin layer of toner 10 is formed over the outer periphery of the developing roller 5. The developing roller 5 is placed to make contact with or located adjacent to the photosensitive medium 1. With the effect of a bias voltage applied from the developing bias power supply 12 the toner 10 is transferred and stuck onto a part of the photosensitive medium 1 on which a latent image is formed, and the latent image becomes visible image.

The toner regulating blade 7 is composed of a metal leaf spring 7*a* having a resiliency and made of stainless steel, phosphor bronze or the like material, and a toner regulating member 7*b* made of urethane rubber having a rubber hardness of 60 degrees, which acts as an elastic member and are co-molded with the one end of the metal leaf spring 7*a*. The urethane rubber functions as the toner-regulating member. The toner-regulating blade 7 is fastened to a blade holder 8 by means of screws. The toner-regulating member 7*b* presses the developing roller 5 with a line pressure 80 g/cm so as to form a thin toner layer on the outer surface of the developing roller 5. In a nonmagnetic one-component developing apparatus of the present embodiment, the toner layer on the developing roller 5 is preferably in a range from 0.4 to 0.6 mg/cm$^2$.

The blade holder 8 holding the toner-regulating blade 7 is fixed with screws.

Sheets 15 stored in a sheet cassette 14 are taken out one by one by a semicircular roller 16, and are conveyed by a conveying roller 17. A conveying roller 17 carries the sheet 15 to the direction as indicated by an arrow A. A registration roller 18 once stops and holds each of the sheet 15 in order to align the sheet with a toner image formed on the photosensitive medium 1, and a driven roller 19 makes contact with the registration roller 18.

A transfer roller 20 is composed of a metal shaft 20*a* covered over its outer peripheral surface with an electroconductive foamed material, having a resistance of $10^7$ ohms. The shaft 20*a* is connected with a transfer bias power source 24, and supports the transfer roller 20 rotatable making contact with the photosensitive medium 1. The transfer bias power source 24 provides a constant current.

The photosensitive medium 1, the developing roller 5 and the toner transfer roller 6 keep a frictional contact to each other at respective contact portions, and each rotates in the direction indicated with the arrow mark as shown in FIG. 1.

As soon as a toner image formed on the photosensitive medium 1 arrives at a point, as a result of the rotation, where the transfer roller 20 and the photosensitive medium 1 are making contact to each other, the sheet 15 reaches concurrently at the point. A transfer bias power source 24 provides a high voltage to the metal shaft 20*a* of transfer roller 20 so as to apply a charge having a polarity reverse to that of the toner 10 onto the rear surface of the sheet 15, and accordingly, the toner image on the photosensitive medium 1 is transferred to the sheet 15. The sheet 15 is carried to the left in the illustration, and held between a heat roller 22 which incorporates a heat source in itself and a press roller 23 of a fixing unit 21 so that a toner image transferred on the sheet 15 is fixed due to the heat and pressure given through the rotation of both heat roller 22 and press roller 23. The photosensitive medium 1, after the toner image formed thereon is transferred onto the sheet 15, is cleaned by a cleaning blade 50 provided for removing residual toner, and a discharger 13 irradiates a light on the photosensitive medium 1 for removing residual charge in preparation for a next process step.

The toner 10 used in the present exemplary embodiment is a toner of the nonmagnetic one-component system, which is obtained by dispersing carbon, wax, charge control agent and the like uniformly into polyester resin.

Next, the developing bias voltage VB, the d.c. voltage VSR of the toner supply bias voltage, the peak-to-peak a.c. voltage VPP of the toner supply bias voltage, and the potential difference VSR−VB between the d.c. voltage VSR of the toner supply bias voltage and the developing bias voltage VB were changed so as to evaluate the image quality.

Conditions of a developing process were as follows:

Frequency f of a.c. Voltage of Toner Supply Bias Voltage: 300 Hz

Process Speed: 76 mm/sec

Peripheral Speed of Developing Roller 5: 105 mm/sec

Peripheral Speed of Toner Supply Roller 6: 75 mm/sec

In the above mentioned conditions, an image having a high density over its entire surface was printed, and the lowering in the density at the leading end part of an image and the lowering in the density at the trailing end part of an image were evaluated by the eyes. The evaluation was made at three stages, that is, O, Δ and X. The results of the evaluations are shown in Table 1; the unit used to represent the voltage is Volt.

As understood from Table 1, the lowering in the density at the leading end part of an image and the lowering in the density at the trailing end part of an image are eliminated when a relationship $100 \leqq |VB| \leqq |VSR|$ is satisfied, and when a relationship $2(|VSR-VB|+50) \leqq |VPP| \leqq =2|VSR|$ is satisfied.

Furthermore, the lowering in the density at the leading end part of an image and the lowering in the density at the trailing end part of an image with the nonmagnetic one-component developing apparatus were eliminated at a higher certainty level when the relationship $100 \leqq |VB| \leqq |VSR|$ and the relationship $2(|VSR-VB|+50) \leqq |VPP| \leqq 2|VSR|$ are satisfied at a same time.

Next, the frequency f of a.c. voltage of toner supply bias voltage, and the relative speed v at the contact position between the developing roller 5 and the toner supply roller 6 were changed so as to evaluate the image quality. The peripheral speed of the toner supply roller 6 was varied for the purpose of changing the relative speed v.

Conditions of a developing process were as follows:

Developing Bias Voltage VB: −250V

D.C. Voltage VSR of Toner Supply Bias Voltage: −350V

Peak-to-peak A.C. Voltage VPP of Toner Supply Bias Voltage: 500V

Process Speed: 76 mm/sec

Peripheral Speed of Developing Roller 5: 105 mm/sec

Nip Width l between Toner Supply Roller 6 and Developing Roller 5: 2 mm

In the above mentioned conditions, an image having a high density over its entire surface was printed, and the eye evaluation was conducted thereon with respect to the periodical uneven developing due to a frequency of an a.c. voltage. The evaluation was made at three stages; that is, O, Δ and X. The results of the evaluation are shown in Table 2.

As understood from Table 2, in the case of the relative speed v=180 mm/sec, the uneven developing becomes unremarkable at a frequency f=90 Hz; it is completely eliminated at a frequency f=120 Hz. In the case of the relative speed v=240 mm/sec, the uneven developing becomes unremarkable at a frequency f=120 Hz; it is completely eliminated at a frequency f=150 Hz. Since a difference in the relative speed between the developing roller 5 and the toner supply roller 6 causes an appropriate frequency f given on the toner supply roller 6 to be different, the following facts became known:

If a time for the toner supply roller 6 passing over the nip width l between the developing roller 5 and the toner supply roller 6 is not longer than a cycle period 1 of a.c. voltage, an unevenness is produced in a toner layer formed on the developing roller 5, which results in an uneven developing. Accordingly, in order to prevent occurrence of unevenness in the toner layer, a relationship $v/l \leqq f$ has to be satisfied. In the present exemplary embodiment, since the nip width between the developing roller 5 and the toner supply roller 6 is 2 mm, the appropriate value of frequency f, when v=180 mm/sec, is not less than 90 Hz.

As mentioned above, the occurrence of periodical uneven developing due to a frequency of an a.c. voltage can be eliminated when a relationship $f \geqq v/l$ is satisfied; where, f (Hz) is frequency of a.c. voltage of toner supply bias voltage, v (mm/sec) is relative speed at the contact position between the developing roller and the toner supply roller, l (mm) is nip width between the developing roller and the toner supply roller.

Although in the present exemplary embodiment the control on image density has been made based on manual input from a control panel, it may be conducted automatically based on detection signals delivered from a temperature sensor, a humidity sensor, an image density detection element and the like elements provided in an electrophotography device. The present invention is applicable also to a case where the image density is automatically controlled.

Further, although it has been explained that the toner regulating member **7*b* is made of urethane rubber, or an elastic material, the toner regulating member 7*b* may be also made of various other rubber materials including silicone rubber, fluorocarbon rubber, acrylic rubber, butadiene rubber, EPDM rubber or the like, or even with a rigid material such as a metal or a resin. It is noted here that a material for the toner regulating member 7*b* is required to have an excellent wear-resistant characteristic, in order to prevent aging effect in the volume of toner sticking to the developing roller 5. Further, the material of developing roller 5** is not limited to an elastic material; it may be a metal roller or a resin roller.

As for the waveform of the a.c. voltage of toner supply bias voltage, a triangular waveform, a rectangular waveform, etc. can be used, besides the sine wave, to obtain the same effect.

As described in the above, a developing apparatus in accordance with the present invention comprises means to control the image density by changing a developing bias voltage, and means to change a d.c. voltage of the toner supply bias voltage. With the above described developing apparatus, the lowering in the density at the leading end part of an image, the lowering in the density at the trailing end part of an image, and the uneven developing are eliminated by changing the d.c. voltage of toner supply bias voltage in accordance with the change in the developing bias voltage.

Furthermore, the scrape-off of unconsumed toner and the toner supply can be made simultaneously with an optimized frequency and voltage of an a.c. voltage to be superimposed on the toner supply bias voltage.

TABLE 1

| VB (Volt) | VSR (Volt) | VSR-VB (Volt) | VPP (Volt) | Density lowering in leading end | Density lowering in trailing end |
|---|---|---|---|---|---|
| −90 | −150 | −60 | 200 | ○ | X |
| −95 | −150 | −55 | 250 | ○ | X |
| −100 | −150 | −50 | 300 | ○ | ○ |
| −150 | −150 | 0 | 350 | ○ | X |
| −250 | −250 | 0 | 50 | X | X |
| −250 | −250 | 0 | 100 | Δ | Δ |
| −250 | −250 | 0 | 150 | ○ | ○ |
| −250 | −250 | 0 | 200 | ○ | ○ |
| −250 | −350 | −100 | 200 | X | ○ |
| −250 | −350 | −100 | 250 | X | ○ |
| −250 | −350 | −100 | 300 | ○ | ○ |
| −250 | −350 | −100 | 350 | ○ | ○ |

○ . . . no density lowering
Δ . . . a little density lowering
X . . . density lowered

TABLE 2

| Frequency | Unevenness evaluation | |
|---|---|---|
| f (Hz) | v = 180 mm/sec | v = 240 mm/sec |
| 30 | X | X |
| 60 | X | X |
| 90 | Δ | X |
| 120 | ○ | Δ |
| 150 | ○ | ○ |
| 180 | ○ | ○ |

○ . . . no unevenness
Δ . . . a little unevenness
X . . . unevenness occurred

What is claimed is:

1. A nonmagnetic one-component developing apparatus for visualizing an electrostatic latent image carrier by attaching a toner thereon, comprising:

a developing roller provided with means for applying a d.c. developing bias voltage thereon;

a toner supply roller arranged for making contact with said developing roller and provided with means for applying a toner bias voltage;

a toner regulating blade for regulating the volume of a toner on said developing roller so as the toner forms a thin layer on the developing roller; and an electrostatic latent image carrier, wherein:

said toner supply bias voltage comprises an a.c. voltage and a d.c. voltage, the d.c. voltage of said toner supply bias voltage is controlled by image density control means in dependence upon a variation in a value of said developing bias voltage, and a relationship $$100 \leqq |VB| \leqq |VSR|$$

is satisfied, where VB is said developing bias voltage (unit: Volt), and VSR is d.c. voltage of said toner supply bias voltage (unit: Volt).

2. A nonmagnetic one-component developing apparatus for visualizing an electrostatic latent image carrier by attaching a toner thereon, comprising:

a developing roller provided with means for applying a d.c. developing bias voltage thereon;

a toner supply roller arranged for making contact with said developing roller and provided with means for applying a toner bias voltage;

a toner regulating blade for regulating the volume of a toner on said developing roller so as the toner forms a thin layer on the developing roller; and an electrostatic latent image carrier, wherein:

said toner supply bias voltage comprises an a.c. voltage and a d.c. voltage, the d.c. voltage of said toner supply bias voltage is controlled by image density control means in dependence upon a variation in a value of said developing bias voltage, and a relationship $$2(|VSR-VB|+50) \leqq |VPP| \leqq 2|VSR|$$

is satisfied, where VB is said developing bias voltage (unit: Volt), VSR is the d.c. voltage of said toner supply bias voltage (unit: Volt), and VPP is a peak-to-peak value of the a.c. voltage of said toner supply bias voltage (unit: Volt).

3. The nonmagnetic one-component developing apparatus of claim 1, wherein a relationship $$2(|VSR-VB|+50) \leqq |VPP| \leqq 2|VSR|$$

is satisfied, where VB is said developing bias voltage (unit: Volt), VSR is the d.c. voltage of said toner supply bias voltage (unit: Volt), and VPP is a peak-to-peak value of the a.c. voltage of said toner supply bias voltage (unit: Volt).

4. The nonmagnetic one-component developing apparatus of claim 3, wherein a relationship $$f \geqq v/l$$

is satisfied, where f is a frequency of the a.c. voltage of said toner supply bias voltage (unit: Hz), v is a relative speed at a contact position between said developing roller and said toner supply roller (unit: mm/sec), and l is a nip width between said developing roller and said toner supply roller (unit: mm).

* * * * *